United States Patent [19]

Hamid et al.

[11] Patent Number: 4,953,618

[45] Date of Patent: Sep. 4, 1990

[54] INJECTION MANIFOLD AND METHOD

[75] Inventors: Syed Hamid, Duncan; Jackie K. Lucas, Marlow, both of Okla.; Russell R. Lockman, Williston, N. Dak.

[73] Assignee: Haliburton Company, Duncan, Okla.

[21] Appl. No.: 296,265

[22] Filed: Jan. 12, 1989

[51] Int. Cl.[5] ..... E21B 49/00

[52] U.S. Cl. ..... 166/250; 73/155; 166/53; 166/75.1; 166/90; 166/305.1

[58] Field of Search ..... 166/305.1, 308, 90, 166/91, 95, 97, 66, 65.1, 75.1, 53, 250; 73/155; 137/486, 569; 417/390, 307

[56] References Cited

U.S. PATENT DOCUMENTS

| | | | |
|---|---|---|---|
| 2,955,654 | 10/1960 | Stogner et al. | 166/75 |
| 3,267,958 | 8/1966 | Weisheit | 137/486 |
| 3,729,986 | 5/1973 | Leonard | 73/155 |
| 3,743,017 | 7/1973 | Fast et al. | 166/308 X |
| 3,941,148 | 3/1976 | Lerner | 137/486 |
| 4,134,423 | 1/1979 | Mayer | 137/486 |
| 4,192,182 | 3/1980 | Sylvester | 73/155 |
| 4,435,127 | 3/1984 | Kränzle et al. | 417/307 X |
| 4,523,459 | 6/1985 | Hastings | 73/155 |
| 4,535,851 | 8/1985 | Kirkpatrick et al. | 175/218 X |
| 4,665,938 | 5/1987 | Brown et al. | 137/486 X |

OTHER PUBLICATIONS

Halliburton Services Sales & Service Catalog, No. 43, pp. 2495–2503, published in 1985.

*Primary Examiner*—Hoang C. Dang

*Attorney, Agent, or Firm*—James R. Duzan; Neal R. Kennedy

[57] ABSTRACT

An injection manifold for use in injecting fluid into a well and method of use. Several embodiments of the apparatus are shown. In each embodiment, a bypass valve is used to control the discharge pressure of a pump, and a throttling valve is used to control the fluid injection flow rate to the well in response to a flow rate measured by a flow meter. In a first embodiment, the throttling is carried out manually. In a second embodiment, the throttling is carried out automatically by a controller which compares a flow rate signal from the meter with a predetermined flow rate set point and sends a corresponding output signal to an actuator of the throttling valve. A third embodiment is a combination manifold which may also be used for flowback tests from the well. In this third embodiment, the electronic controller may also be used to control the flow rate during the flowback test in response to a flow rate signal from the flow meter. A method of injecting fluid into a well using the apparatus is also disclosed.

19 Claims, 2 Drawing Sheets

INJECTION MANIFOLD AND METHOD

BACKGROUND OF THE INVENTION

1. Field Of The Invention

This invention relates to apparatus and methods for injecting fluid into a well and flowing fluid back therefrom such as in microfrac tests (also called stress tests) and minifrac tests, and more particularly, to an injection manifold and method of use thereof which bypasses fluid from a supply pump back to a supply reservoir.

2. Description Of The Prior Art

In microfrac and minifrac tests, fluid is injected into the well at rates typically ranging from one to twenty gallons per minute to obtain certain reservoir characteristics. These flow rates are too low to be handled by standard multi-purpose pumps used at the well site.

One such pump typically used is the Halliburton HT-400 which is a positive displacement, high pressure, triplex plunger-type pump. In a prior method of injecting fluid in microfrac or minifrac tests, a small plunger kit is installed in the HT-400 pump fluid end to obtain the low flow rates desired for such tests. This small plunger kit, which effectively reduces the bore of the pump and thus the output capacity thereof, is relatively expensive. Further, such kits typically require two to three hours for installation and one to two hours for removal so that the pump can again be used for its normal purposes. This is a disadvantage because the pump is tied up and cannot be used on other cementing or fracturing jobs until the small plunger kit is removed. Further, accurate and quick changes in the flow rate are still difficult to make. An additional disadvantage is that the rangeability of the small plunger kit is limited. This rangeability limitation requires different sizes of plungers for different flow rate ranges, which, of course, results in the cost and time disadvantages already mentioned.

Accordingly, there is a need for an apparatus and method of injecting low flow rates of fluid into wells during microfrac and minifrac tests which do not involve the time and cost burden of refitting a pump with a small plunger kit. The injection manifold of the present invention includes a bypass valve which adjusts the discharge pressure of the pump and allows the relatively low one to twenty gallon per minute flow rates to be injected into the pump without the necessity of installing a small plunger kit on the pump.

SUMMARY OF THE INVENTION

The injection manifold of the present invention is adapted for injecting fluid into a well formation without the necessity of installing a small plunger kit in a pump. The injection manifold comprises a line interconnecting a fluid supply reservoir with the well, pumping means for pumping fluid from the supply reservoir to the well, metering means in the line for measuring a fluid flow rate through the line, valve means in the line for adjusting fluid flow therethrough in response to the fluid flow rate, and bypass means for adjusting a discharge pressure of the pumping means. The bypass means is preferably characterized by a bypass valve disposed in a bypass line such that excess fluid from the pump is bypassed back to the supply reservoir.

The injection manifold also preferably comprises filtering means, such as a screen, in the line for filtering debris from fluid discharge from the pump. This can be used to protect the valve means, metering means and bypass means from such debris.

The metering means is preferably characterized by a flow meter, such as a Halliburton turbine flow meter or a mag meter. The valve means is preferably characterized by a valve with an actuator. The valve may be a needle valve.

In one embodiment, the apparatus further comprises control means for controlling a setting of the valve means in response to the fluid flow rate measured by the metering means and to a predetermined flow rate. The control means comprises microprocessor means or analog controller means for comparing an input signal indicating the flow rate measured by the metering means and a predetermined flow rate set point and for sending an output signal to the actuator of the valve means.

In another embodiment, the manifold further comprises a second line interconnecting the well with a discharge reservoir and second valve means for adjusting fluid flow through the second line from the well to the discharge reservoir in a flow-back test. Preferably, a portion of the second line is also a portion of the first mentioned line which portion includes the first mentioned valve means and the metering means. The control means may also be adapted for controlling the second valve means such that the flow rate through the second line is maintained relatively constant. Preferably, the second valve means is piped parallel to the first mentioned valve means, and the second valve means is smaller than the first mentioned valve means.

A method of injecting fluid from a supply reservoir into a well using the present invention comprises the steps of providing a pump in a line between the supply reservoir and the well, providing a valve in the line, providing flow measuring means in the line for measuring a fluid flow rate therethrough, adjusting a position of the valve in response to the fluid flow rate, and adjusting a discharge pressure of the pump. The step of adjusting a discharge pressure comprises bypassing a portion of the fluid discharged from the pump back to the supply reservoir. The flow measuring means sends a flow rate signal to an actuator of the valve, and the method may further comprise the step of comparing the flow rate signal with a flow rate set point. The step of comparing is characterized by comparing the flow rate signal with the set point in a microprocessor or analog controller.

An important object of the invention is to provide an apparatus for injecting fluid into a well formation without the necessity of installing a small plunger kit on a pump.

Another object of the invention is to provide an injection manifold in which pump discharge pressure is controlled by a bypass means.

A further object of the invention is to provide an injection manifold in which the injection fluid flow rate is controlled in response to the flow rate measured by a metering means.

Still another object of the invention is to provide a combination injection and flow-back test manifold.

Additional objects and advantages of the invention will become apparent as the following detailed description of the preferred embodiments is read in conjunction with the drawings which illustrate such preferred embodiments.

DESCRIPTION OF THE PREFERRED EMBODIMENTS

Figure 1:
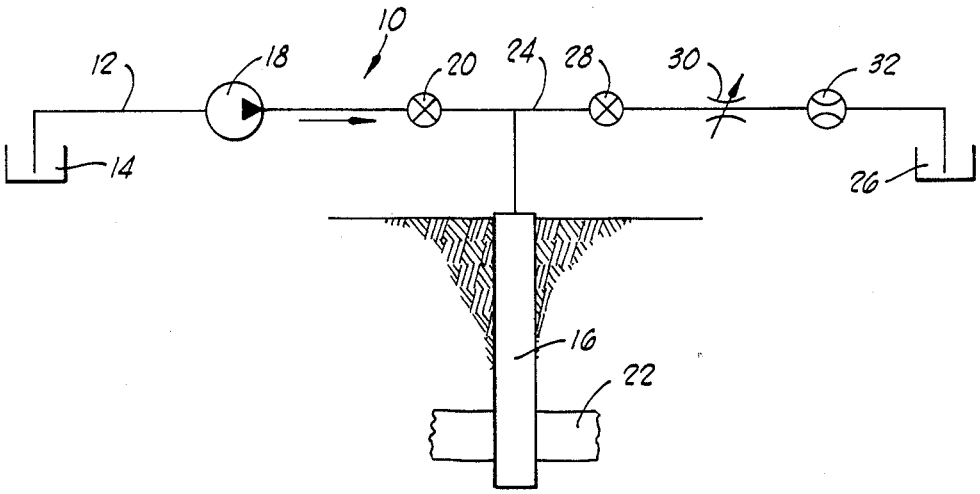
FIG. 1 PRIOR ART
FIG. 1 shows a prior fluid injection and well flow-back system.

Referring now to the drawings, and more particularly to FIG. 1, a prior art well fluid injection and flow-back system is illustrated and generally designated by the numeral 10. The prior art system generally includes a manifold comprising a line 12 which interconnects a supply reservoir 14 with a well 16. A pump 18, such as the Halliburton HT-400 triplex pump pumps fluid from reservoir 14 through a valve 20 into well 16 and formation 22 to be tested.

For microfrac and minifrac tests, a small plunger kit must be installed in pump 18 so that its output will be in the relatively low flow rates, such as one to twenty gallons per minute, that are desired for such tests. Valve 20 is basically just a line shut-off valve, such as the Halliburton Lo-Torc plug valve. The valve is not used for throttling; it is simply in the line to close the line off when desired.

Prior art apparatus 10 may also include a flow back manifold comprising a line 24 extending between well 16 and a discharge area, such as discharge reservoir 26. This flow-back system is used to flow back from formation 22, through well 16 and into discharge reservoir 26.

Disposed in line 24 are a shut-off valve 28, a control valve 30, such as a needle valve, and a flow meter 32, such as a Halliburton turbine flow meter or a mag meter with display.

Flow meter 32 displays the flow rate of the liquid flowing therethrough, and thus through line 24, and the operator manually controls valve 30 in response to the continual pressure decline which affects the observed flow rate through flow meter 32. Ideally, the flow rate is maintained constant so that an accurate estimation of the closure pressure of the well may be obtained. Unfortunately, this is highly dependent upon the skill of the operator, and if the flow rate is not maintained as constant as possible, an incorrect closure pressure estimation may be the result.

Using prior art apparatus 10, shown in FIG. 1, valve 20 is opened and valve 28 is closed during the fluid injection process, and valve 20 is closed and valve 28 is opened during the flow-back tests.

Figure 2:
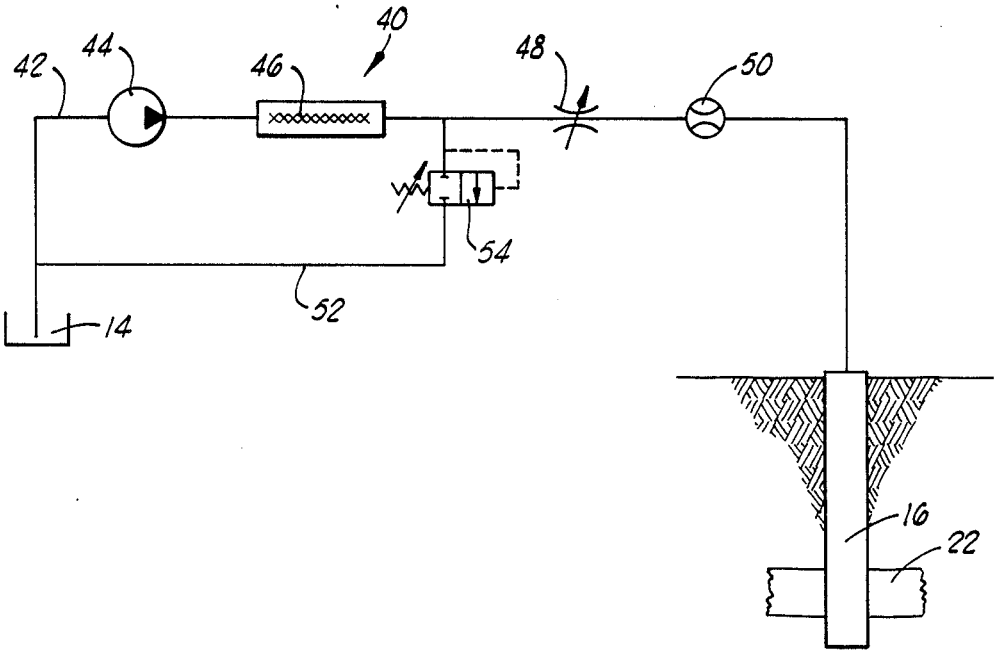
FIG. 2 illustrates a first embodiment of the injection manifold of the present invention.

Referring now to FIG. 2, a first embodiment of the injection manifold of the present invention is shown and generally designated by the numeral 40. As with prior art system 10, manifold 40 interconnects a supply reservoir 14 with a well 16 for injecting fluid into formation 22.

In the first preferred embodiment, injection manifold 40 includes a line 42 with a pumping means preferably characterized by a pump 44, such as a Halliburton HT-400 pump, therein. Located in line 42 with pump 44 is a filtering means, such as a screen 46 for filtering debris from the fluid discharged from pump 44. Also included in line 42 is a valve means, such as valve 48, and a flow measuring or metering means, such as a flow meter 50. Preferably, flow meter 50 is downstream from valve 48, but the meter could be upstream if the pressure rating thereof were sufficient. Valve 48 is of a kind known in the art, such as a needle valve, and flow meter 50 is also of a kind known in the art, such as a Halliburton turbine flow meter or a mag meter with display.

A bypass line 52 interconnects the discharge of pump 44 with supply reservoir 14. Disposed in bypass line 52 is a bypass means, such as bypass valve 54, for adjusting the discharge pressure of pump 44 and bypassing fluid back to supply reservoir 14. Preferably, line 52 is connected to line 42 at a point downstream from filtering means 46, so that bypass valve 54 is protected from debris that may be in the fluid discharged from pump 44.

Pump 44 is a standard pump without a small plunger kit. The flow rate of pump 44 is considerably more than that needed for the microfrac or minifrac tests. During fluid injection, the injection rate of fluid from the pump is adjusted by valve 48. The operator is required to adjust the injection flow rate as the wellhead pressure changes during injection. Flow rate feedback is provided to the operator by the flow rate display on meter 50. Bypass valve 54 is set so that it will bypass fluid back to supply reservoir 14 when the discharge pressure of pump 44 reaches a predetermined level.

For example, if pump 44 is an HT-400 pump set to run at a one barrel per minute flow rate, bypass valve 54 may be set at a level such as approximately 1,000 psi above the maximum expected injection pressure at the wellhead of well 16. When this pressure level is reached, bypass valve 54 opens, thus flowing the excess fluid back to supply reservoir 14. Thus, only the desired flow rate, such as one to twenty gallons per minute, is supplied to valve 48 and is adjusted thereby. Thus, first embodiment injection manifold 40 provides the appropriate fluid flow rate to formation 22 without requiring the expensive and time-consuming.modification of pump 44 to include a small plunger kit.

Figure 3:
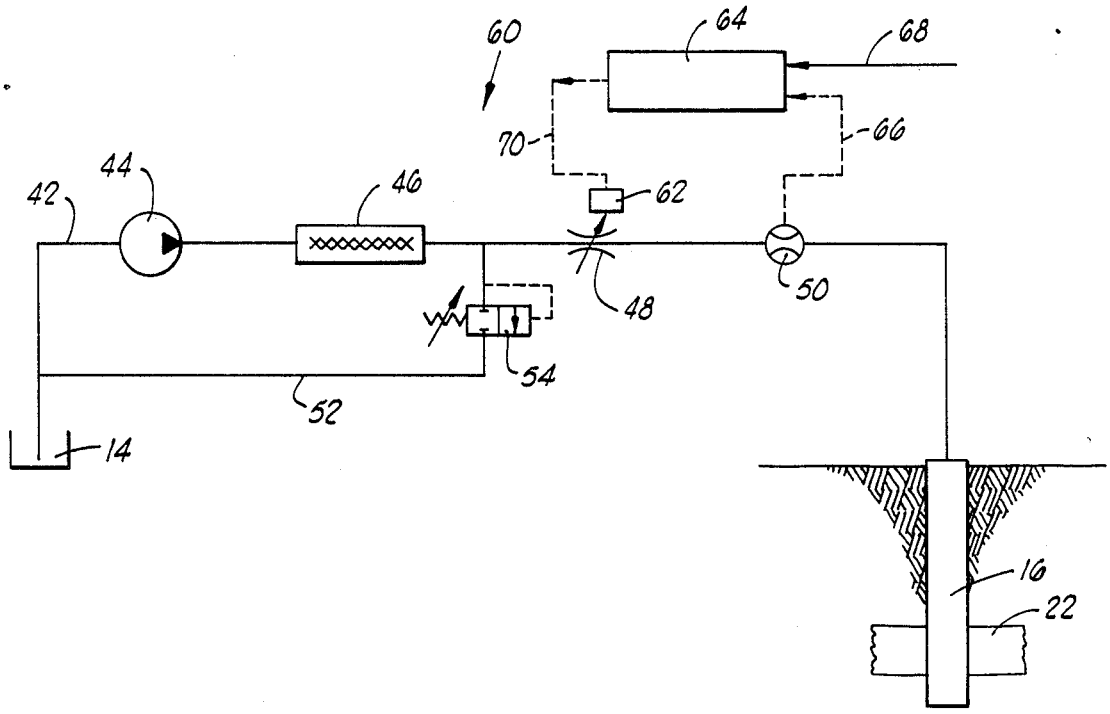
FIG. 3 shows a second embodiment of the injection manifold of the present invention.

Referring now to FIG. 3, a second embodiment of the injection manifold of the present invention is shown and generally designated by the numeral 60. The second embodiment injection manifold 60 includes all of the components of first embodiment manifold 40, but adds automatic control of valve 48 in response to a fluid flow signal from flow meter 50. In second embodiment injection manifold 60, valve 48 has an actuator 62.

A control means, such as an electronic controller 64, is connected to flow meter 50 and actuator 62 of valve 48. Controller 64 is adapted for receiving an input signal 66, in the form of a flow rate signal from flow meter 50. Controller 64 preferably comprises microprocessor means or analog controller means for comparing input signal 66 with a predetermined flow rate set point 68 sent from a remote location and for sending an output signal 70 in response to the difference between flow rate signal 66 and set point 68 to actuator 62. Output signal 70 sent to actuator 62 controls the variably open position of valve 48 and thus controls the flow rate through manifold 60 to well 16.

Controller 64 is adapted for constantly comparing input signal 66 with set point 68 sent from the remote location and sending output signal 70 to actuator 62. Because of this constant, nearly instantaneous control, controller 64 provides a much quicker and more accurate control of valve 48 than can be obtained with manually operated first embodiment injection manifold 40.

Figure 4:
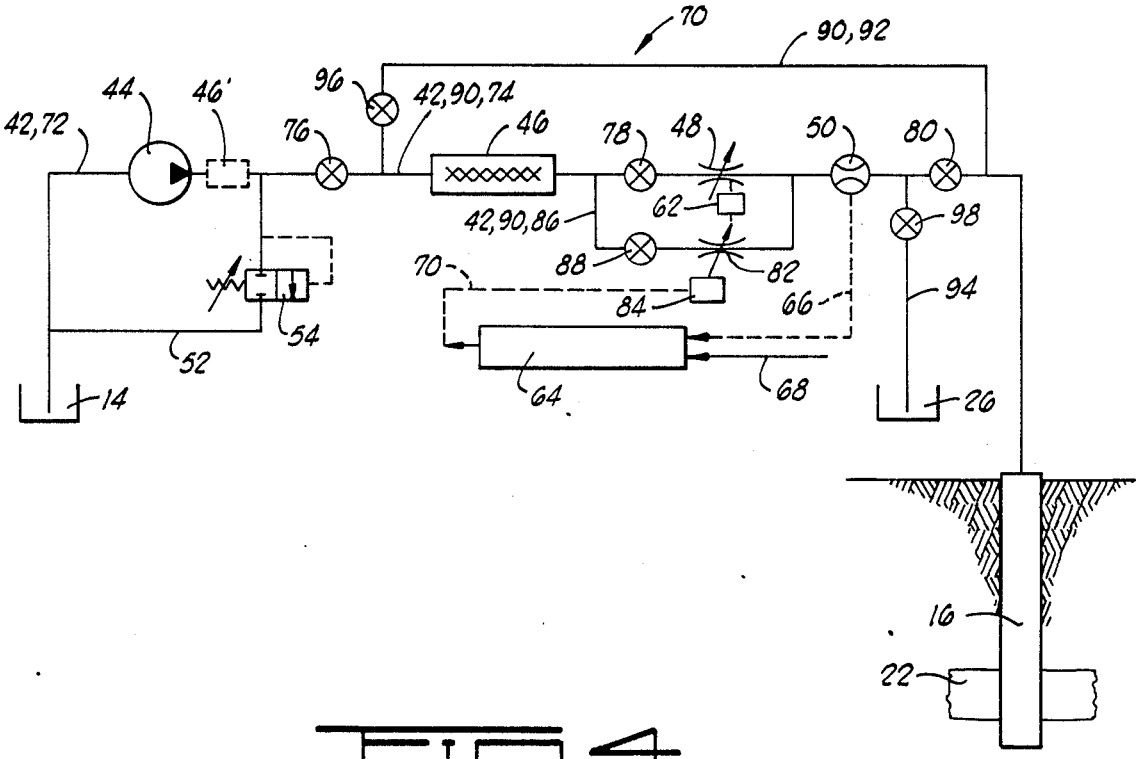
FIG. 4 illustrates a third embodiment of the apparatus, including means for flowing back fluid from the well.

Referring now to FIG. 4, a third embodiment of the injection manifold is shown and generally designated by the numeral 70. Third embodiment injection manifold 70 is actually a combination manifold which takes advantage of the commonality of components used in the injection and flow-back manifolds of the prior art. In other words, manifold 70 may be used for both fluid injection operations and flow-back testing, as will be discussed further herein.

Third embodiment manifold 70 includes the same basic components, identified by the same reference numerals, as second embodiment manifold 60. However, a number of additional components have been added so that the system may also be used in flow-back testing.

In third embodiment manifold 70, line 42 may be referred to as a first line 42 and includes a first branch 72 and a second branch 74. First branch 72 includes pump 44 and a shut-off valve 76 therein. Bypass line 52 connects to first branch 72 of first line 42 between pump 44 and shut-off valve 76.

As will be seen by those skilled in the art, bypass valve 54 is not protected from debris from pump 44 with this piping arrangement. Therefore, an alternate screen 46'could be positioned in first branch 72 of first line 42 between pump 44 and the intersection of line 42 with bypass line 52 as shown in hidden lines in FIG. 4.

Second branch 74 of first line 42 includes screen 46, valve 48 with actuator 62, and flow meter 50. Also included in branch 74 is a shut-off valve 78 between screen 46 and valve 48 and another shut-off valve 80 downstream from flow meter 50. Another valve 82 with actuator 84 is disposed in a third branch 86 of first line 42. Third branch 86 also includes another shut-off valve 88.

The flow-back portion of third embodiment manifold 70 includes a second line 90 having a first branch 92. Second line 90 also includes a second and third branch which is the same second branch 74 and third branch 86 included in first line 42. Second line 90 also includes a leg 94 extending from second branch 74 to a discharge reservoir 26. This discharge reservoir 26 is the same as used in prior art system 10.

A shut-off valve 96 is disposed in first branch 92 of second line 90 and another shut-off valve 98 is disposed in leg 94 of second line 90.

When third embodiment manifold 70 is used for fluid injection into formation 22 in well 16, shut-off valves 76, 78 and 80 are open, and shut-off valves 96, 88 and 98 are closed. It will be seen that in this configuration, third embodiment manifold 70 functions in a manner substantially identical to second embodiment injection manifold 60. Controller 64 is adapted for controlling the position of either or both valve 48 through actuator 62 or valve 82 through actuator 84. Because shut-off valve 78 is open and shut-off valve 88 is closed, only valve 48 has any effect on the fluid flow through first line 42.

When third embodiment manifold 70 is used for a flow-back test, shut-off valves 98, 88 and 96 are open, and shut-off valves 80, 78 and 76 are closed. It will thus be seen that well fluid may flow from well 16 through first branch 92 of second line 90 and then through second branch 74 and third branch 86 which includes screen 46, valve 82 and flow meter 50, then through leg 94 to discharge reservoir 26. Controller 64 controls actuator 84 of valve 82 and thus controls the fluid flow from well 16 to discharge reservoir 26. Valve 48 is out of the system since shut-off valve 78 is closed.

In most cases, the throttling valves, such as valve 48 or 82, used in fluid injection operations and in flow-back tests, respectively, are of different sizes. Valve 82, provided for flow-back tests is generally smaller in size than valve 48 used in fluid injection operations. Typically, valve 82 will be a $\frac{1}{4}''$ valve, and valve 48 will be a $\frac{1}{2}''$ valve, although the invention is not intended to be limited to these particular valve sizes. Further, in cases where one size of valve would be adequate for both operations, only one throttling valve with actuator would be necessary. In this case, the corresponding shut-off valve can be omitted.

In using any embodiments of the injection manifold of the present invention, a method of injecting fluid into well 16 from supply reservoir 14 may be carried out comprising the steps of adjusting the variably open position of valve 48 in response to the fluid flow rate measured through flow meter 50 and bypassing the excess fluid supplied by pump 44 back to supply reservoir 14. In second and third embodiments 60 and 70, the step of adjusting the variably open position of valve 48 is in response to input signal 66 and flow rate set point 68. In the second and third embodiments, the step of adjusting comprises sending an output signal 70 from the microprocessor means or analog controller means of controller 64 to actuator 62 of valve 48.

In using third embodiment 70 as a flow-back control manifold, a method of flowing back fluid from well 16 to discharge reservoir 26 may be carried out comprising the step of adjusting the variably open position of valve 82 in response to input signal 66 and flow rate set point 68. This step of adjusting comprises sending output signal 70 from the microprocessor means or analog controller means of controller 64 to actuator 84 of valve 82.

It will be seen, therefore, that the injection manifold and method of use of the present invention are well adapted to carry out the ends and advantages mentioned, as well as those inherent therein. While presently preferred embodiments of the invention have been shown for the purposes of this disclosure, numerous changes in the arrangement and construction of parts may be made by those skilled in the art. All such changes are encompassed within the scope and spirit of the appended claims.

What is claimed is:

1. An apparatus for use on a well, said apparatus comprising:
   - a first line interconnecting a fluid supply reservoir with said well;
   - pumping means for pumping fluid from said supply reservoir to said well;
   - metering means in said first line for measuring a fluid flow rate through said first line;
   - valve means in said first line for adjusting fluid flow therethrough in response to said fluid flow rate;
   - bypass means for adjusting a discharge pressure of said pumping means;
   - a second line interconnecting said well with a discharge reservoir; and
   - second valve means for adjusting fluid flow through said second line from said well to said discharge reservoir in response to a second fluid flow rate through said metering means in a flow- back test.

2. The apparatus of claim 1 wherein said bypass means bypasses fluid back to said supply reservoir.

3. The apparatus of claim 1 further comprising filter means in said first line for filtering debris from fluid discharged from said pump.

4. The apparatus of claim 1 wherein said metering means is a turbine flow meter.

5. The apparatus of claim 1 further comprising control means for controlling a setting of said first valve means in response to said fluid flow rate measured by said metering means and to a predetermined flow rate.

6. The apparatus of claim 5 wherein said control means comprises means for comparing said flow rate measured by said metering means with said predetermined flow rate.

7. The apparatus of claim 1 wherein said first valve means is characterized by a valve with an actuator.

8. The apparatus of claim 1 wherein said metering means is disposed in said first line downstream of said first valve means.

9. The apparatus of claim 1 wherein the pump discharge pressure is approximately 1,000 psi greater than a fluid injection pressure measured at a wellhead of said well.

10. The apparatus of claim 1 wherein a portion of said second line is a portion of said first line.

11. The apparatus of claim 1 further comprising control means for controlling a setting of said second valve means in response to a flow rate measured by said metering means and to a predetermined flow rate.

12. The apparatus of claim 11 wherein said control means comprises means for comparing said flow rate measured by said metering means with said predetermined flow rate.

13. The apparatus of claim 1 wherein said control means controls said second valve means such that the flow rate through said second line is maintained relatively constant.

14. The apparatus of claim 1 wherein said second valve means is parallel to said first valve means.

15. The apparatus of claim 1 wherein said second valve means is smaller than said first valve means.

16. A method of injecting fluid from a supply reservoir into a well and conducting a flow-back test on said well, said method comprising the steps of:

providing a pump in a first line between said supply reservoir and said well;

providing a first valve in said first line;

providing flow measuring means in said first line for measuring a fluid flow rate therethrough;

adjusting a position of said first valve in response to said fluid flow rate;

adjusting a discharge pressure of said pump;

closing a valve between said supply reservoir and said first valve such that fluid flow therebetween is prevented;

providing a second line between said well and a discharge reservoir;

providing a second valve in said second line; and adjusting a position of said second valve in response to a second fluid flow rate through said flow measuring means.

17. The method of claim 16 wherein said step of adjusting a discharge pressure comprises bypassing a portion of fluid discharged from said pump back to said supply reservoir.

18. The method of claim 16 wherein:

said flow measuring means sends a flow rate signal to an actuator of said first valve; and further comprising the step of comparing said flow rate signal with a flow rate set point.

19. An apparatus for use on a well, said apparatus comprising:

a line interconnecting a fluid supply reservoir with said well;

pumping means for pumping fluid from said supply reservoir to said well;

metering means in said line for measuring a fluid flow rate through said line;

valve means in said line for adjusting fluid flow therethrough in response to said fluid flow rate;

bypass means for adjusting a discharge pressure of said pumping means;

a second line interconnecting said well with a discharge reservoir, wherein:

a portion of said second line is a portion of said first mentioned line; and said portion of said first mentioned line includes said first mentioned valve means and said metering means; and second valve means for adjusting fluid flow through said second line from said well to said discharge reservoir in a flow-back test.

* * * * *